US011725839B2

(12) United States Patent
Wu et al.

(10) Patent No.: US 11,725,839 B2
(45) Date of Patent: Aug. 15, 2023

(54) AIR CONDITIONER CONTROL METHOD AND DEVICE AND AIR CONDITIONER

(71) Applicant: Gree Electric Appliances, Inc. of Zhuhai, Guangdong (CN)

(72) Inventors: Xuewei Wu, Guangdong (CN); Huasheng Yang, Guangdong (CN); Jingui Xie, Guangdong (CN); Yuanchang Mao, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 275 days.

(21) Appl. No.: 17/261,252

(22) PCT Filed: May 14, 2019

(86) PCT No.: PCT/CN2019/086870
§ 371 (c)(1),
(2) Date: Jan. 19, 2021

(87) PCT Pub. No.: WO2020/048151
PCT Pub. Date: Mar. 12, 2020

(65) Prior Publication Data

US 2021/0270486 A1 Sep. 2, 2021

(30) Foreign Application Priority Data

Sep. 6, 2018 (CN) ..... 201811038797.9

(51) Int. Cl.
*F24F 11/46* (2018.01)
*F24F 11/30* (2018.01)
*F24F 11/62* (2018.01)
*F24F 120/12* (2018.01)

(52) U.S. Cl.
CPC ..... *F24F 11/46* (2018.01); *F24F 11/30* (2018.01); *F24F 11/62* (2018.01); *F24F 2120/12* (2018.01)

(58) Field of Classification Search
CPC .. F24F 11/30; F24F 11/46; F24F 11/79; F24F 2120/10; F24F 2120/12; F24F 2120/14; F24F 11/62
See application file for complete search history.

(56) References Cited

FOREIGN PATENT DOCUMENTS

| | | | | | |
|---|---|---|---|---|---|
| CN | 101165425 | A | | 4/2008 | |
| CN | 101165427 | A | | 4/2008 | |
| CN | 101329091 | A | | 12/2008 | |
| CN | 101498475 | A | | 8/2009 | |
| CN | 102414519 | A | | 4/2012 | |
| CN | 104019493 | A | | 9/2014 | |
| CN | 104748236 | A | * | 7/2015 | ..... F24F 11/0034 |
| CN | 104949281 | A | | 9/2015 | |
| CN | 105588251 | A | * | 5/2016 | ..... F24F 11/30 |
| CN | 105928148 | A | * | 9/2016 | |
| CN | 106091289 | A | | 11/2016 | |

(Continued)

*Primary Examiner* — Crystal J Barnes-Bullock
(74) *Attorney, Agent, or Firm* — The Webb Law Firm

(57) ABSTRACT

An air conditioner control method includes: determining whether a local air conditioner detects a positioning marker; when the local air conditioner detects the positioning marker, determining whether there are any other air conditioner which detect the positioning marker simultaneously with the local air conditioner; and if so, obtaining a position relation between the local air conditioner and the other air conditioners according to the positioning marker.

17 Claims, 5 Drawing Sheets

(56) References Cited

FOREIGN PATENT DOCUMENTS

| | | | | | |
|---|---|---|---|---|---|
| CN | 107525237 | A | | 12/2017 | |
| CN | 105091202 | B | * | 4/2018 | |
| CN | 105627494 | B | * | 8/2018 | |
| CN | 108895628 | A | * | 11/2018 | |
| CN | 109059202 | A | * | 12/2018 | ..... F24F 11/62 |
| CN | 109539494 | A | | 3/2019 | |
| CN | 105258305 | B | * | 7/2019 | |
| CN | 111174297 | B | * | 3/2023 | ..... F24F 1/02 |
| JP | 2004150731 | A | | 5/2004 | |
| JP | 2009085527 | A | | 4/2009 | |
| JP | 2015114085 | A | | 6/2015 | |
| JP | 5987882 | B2 | * | 9/2016 | ..... F24F 1/0014 |
| JP | 7122808 | B2 | * | 8/2022 | |
| WO | 2004044498 | A1 | | 5/2004 | |

* cited by examiner

AIR CONDITIONER CONTROL METHOD AND DEVICE AND AIR CONDITIONER

CROSS-REFERENCE TO RELATED APPLICATIONS

The present disclosure is a U.S. National Stage Application under 35 U.S.C. § 371 of International Patent Application No. PCT/CN2019/086870, filed on May 14, 2019, which is based on and claims the benefit of priority to the Chinese patent application No. 201811038797.9 filed on Sep. 6, 2018, the disclosure of both of which are hereby incorporated by reference in their entirety into the present application.

TECHNICAL FIELD

This disclosure belongs to the technical field of air conditioners, and particularly relates to an air conditioner control method and device and an air conditioner.

BACKGROUND OF THE INVENTION

In some places, such as supermarkets, offices and the like, a plurality of air conditioners are often installed. In these places, intelligent air conditioners can be adopted to identify people so as to achieve intelligent control and energy conservation.

SUMMARY OF THE INVENTION

In a first aspect, the present disclosure provides a method of obtaining a position relation of air conditioners, comprising:

determining whether a local air conditioner detects a positioning marker; when the local air conditioner detects the positioning marker, determining whether there are any other air conditioner that detect the positioning marker simultaneously with the local air conditioner; and if so, obtaining a position relation between the local air conditioner and the other air conditioner according to the positioning marker.

In a second aspect, the present disclosure provides a device for obtaining a position relation of air conditioners, comprising:

a first determining module configured to determine whether a local air conditioner detects a positioning marker;

a second determining module configured to determine whether there are any other air conditioner that detect the positioning marker simultaneously with the local air conditioner when the local air conditioner detects the positioning marker; and an obtaining module configured to, if so, obtain a position relation between the local air conditioner and the other air conditioner according to the positioning marker.

In a third aspect, the present disclosure provides an air conditioner, comprising:

a detecting module configured to detect a positioning marker;

a communication module configured to acquire information of peripheral air conditioners detecting the positioning marker; and the air conditioner control device of any of the above.

According to an aspect of the some embodiments of the present disclosure, there is provided an air conditioner control method, comprising: determining whether a local air conditioner detects a positioning marker; determining whether there are any other air conditioner that detect the positioning marker simultaneously with the local air conditioner, in the case that the local air conditioner detects the positioning marker; and determining a position relation between the local air conditioner and the other air conditioner according to the positioning marker, in the case that the air conditioner detect the positioning marker simultaneously with the local air conditioner.

According to an aspect of some other embodiments of the present disclosure, there is provided an air conditioner control device, comprising: a first determining module, configured to determine whether a local air conditioner detects a positioning marker; a second determining module, configured to determine whether there are any other air conditioner that detect the positioning marker simultaneously with the local air conditioner in the case that the local air conditioner detects the positioning marker; and a third determining module, configured to determine a position relation between the local air conditioner and the other air conditioner according to the positioning marker in the case that the other air conditioner detect the positioning marker simultaneously with the local air conditioner.

According to an aspect of still other embodiments of the present disclosure, there is provided an air conditioner control device comprising: a memory; and a processor coupled to the memory, wherein the processor is configured to perform any of the air conditioner control methods above based on instructions stored in the memory.

According to an aspect of further embodiments of the present disclosure, there is provided a computer-readable storage medium, on which computer program instructions are stored, wherein the instructions, when executed by a processor, implement any of the air conditioner control methods above.

In addition, according to an aspect of some embodiments of the present disclosure, there is provided an air conditioner comprising: a detector configured to detect a positioning marker; a communication device, configured to acquire detection information of the positioning marker by air conditioners adjacent to a detection area of the local air conditioner; and any of the air conditioner control device above.

BRIEF DESCRIPTION OF THE DRAWINGS

In order to illustrate the embodiments of the present disclosure or the technical solutions in the prior art more clearly, the drawings required to be used in the embodiments or the descriptions of the prior art will be briefly described below, it is obvious that the drawings in the following description are merely some of the embodiments of the present disclosure, and other drawings can still be obtained by those of ordinary skill in the art without making creative efforts.

DETAILED DESCRIPTION

In order to make the objectives, technical solutions and advantages of the present disclosure more clearly, the technical solutions of the present disclosure will be described in detail below. It should be apparent that the described embodiments are only a few embodiments of the present disclosure, and not all embodiments. All other embodiments, which can be derived by those of ordinary skill in the art from the embodiments of the present disclosure given herein without making any creative effort, shall fall within the protection scope of the present disclosure.

In practical situations, installation positions of air conditioners may be too close, resulting in overlapping areas of action. For example, an air conditioner A and an air conditioner B are installed too closely, resulting in an overlapping detection area; if someone is located in the overlapping area, he or she will be detected by the air conditioner A and the air conditioner B simultaneously, and both air conditioners will carry out a corresponding control action, and the person in the overlapping area will be blew by two air conditioners simultaneously. There may be a problem that, for the person located in the overlapping area, simultaneous blowing of the two air conditioners against the person may cause discomfort and also cause a waste of electric energy. Therefore, a position relation of air conditioners has a certain influence on the control of air conditioners.

In order to overcome problems in the related art at least to a certain extent, the present disclosure provides an air conditioner control method and device and an air conditioner, which are favorable for providing accurate position information for the control of intelligent air conditioners with overlapping detection areas.

Figure 1:
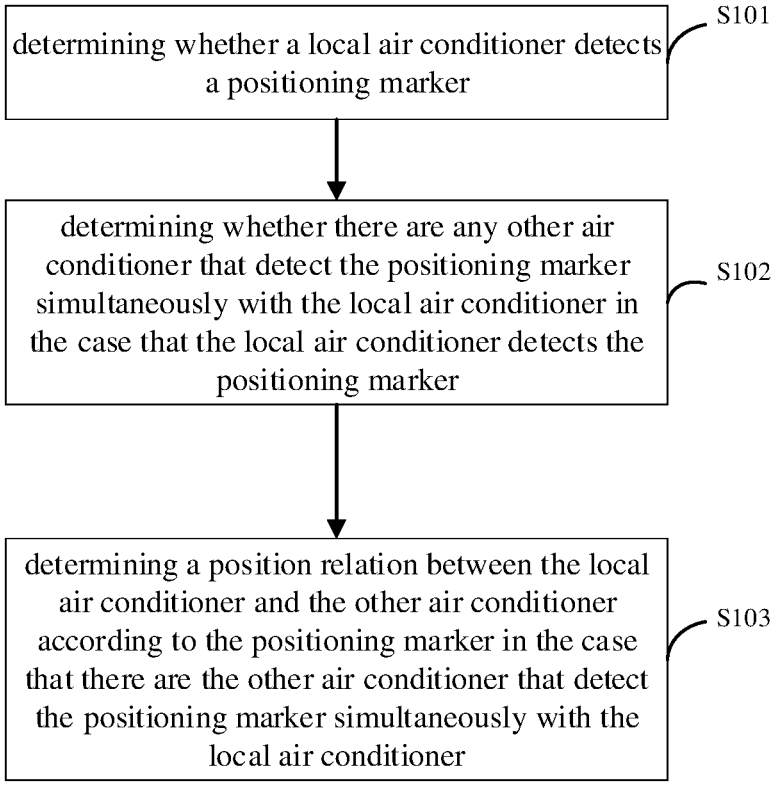
FIG. 1 is a schematic flowchart of an air conditioner control method according to an embodiment of the present disclosure.

FIG. 1 is a schematic flowchart of an air conditioner control method according to an embodiment of the present disclosure, and as shown in FIG. 1, the method comprises the following steps:

in step S101, determining whether a local air conditioner detects a positioning marker.

The positioning marker needs to be easily detected and identified by the air conditioner, so the positioning marker needs to have characteristic information, and accordingly, the air conditioner needs to be provided with a detecting device capable of detecting the characteristic information of the positioning marker.

For example, in some embodiments, the characteristic information of the positioning marker may be temperature information, and in practical applications, the positioning marker may be a heat source, wherein the heat source needs to be different from an ambient temperature so as to be accurately identified, for example, the heat source may be a person, a kettle containing hot water, and the like.

Accordingly, in a specific application, the air conditioner may detect the temperature of the heat source through a configured infrared sensor, and identify the heat source by detecting the temperature of the heat source.

It will be appreciated that the characteristic information of the positioning marker may also be other information, such as a shape, size, etc. of the positioning marker. Accordingly, in a specific application, the air conditioner is provided with a sensor capable of detecting the shape and size, for example, a radar sensor.

In some embodiments, determining whether the local air conditioner detects the positioning marker comprises: acquiring detection information of a detection area corresponding to the local air conditioner; and determining whether the local air conditioner detects the positioning marker according to the detection information of the detection area corresponding to the local air conditioner.

In some embodiments, each air conditioner is configured with a detecting sensor capable of detecting the positioning marker, wherein the range that can be detected by the detecting sensor is a detection area of the air conditioner, and the detecting sensor is able to continuously detect the detection area and obtain detection information when working; if an object appears in the detection area, the detection information will change, and therefore, it can be determined whether the local air conditioner detects the positioning marker according to the detection information of the detection area corresponding to the local air conditioner.

In some embodiments, determining whether the local air conditioner detects the positioning marker according to the detection information of the detection area corresponding to the local air conditioner comprises: determining whether detection information matched with the characteristic information of the positioning marker appears according to preset characteristic information of the positioning marker, and if so, determining that the local air conditioner detects the positioning marker.

The embodiment is described below through specific application scenarios. In an application scenario, taking an air conditioner provided with an infrared sensor as an example, the infrared sensor corresponds to a detection area, performs temperature detection on the detection area, and obtains temperature profile information of the detection area. A positioning marker being a heat source is taken as an example, and a characteristic temperature of the heat source is assumed 50° C. The characteristic temperature of the heat source is preset at 50° C. in the air conditioner by a user. The infrared sensor detects the temperature of the detection area and obtains temperature profile information of the detection area; when the heat source does not appear in the detection area, the temperature information of 50° C. (or within a certain temperature range, such as [45° C., 55° C.]) does not appear in the temperature profile detection information of the detection area, and the heat source is determined failing to be detected according to the characteristic temperature of 50° C. of the heat source preset in the air conditioner by the user. When the heat source appears in the detection area, the temperature information of 50° C. (or within a certain temperature range, such as [45° C., 55° C.]) appears in the temperature profile information of the detection area, and the heat source is determined to be detected according to the characteristic temperature of 50° C. of the heat source preset in the air conditioner by the user.

Step S102, when the local air conditioner detects the positioning marker, determining whether there are any other air conditioner that detect the positioning marker simultaneously with the local air conditioner.

In practical applications of the above step, the local air conditioner is required to be capable of communicating with peripheral air conditioners, wherein the peripheral air conditioners refer to air conditioners with a detection area adjacent to that of the local air conditioner. The peripheral air conditioner is also provided with a detecting sensor capable of detecting a positioning marker, and the local air conditioner keeps communication with the peripheral air conditioners so as to enable the local air conditioner to determine whether there are air conditioners that detect the positioning marker simultaneously with the local air conditioner among the peripheral air conditioners.

In some embodiments, when the local air conditioner detects the positioning marker, determining whether there are air conditioners that detect the positioning marker simultaneously with the local air conditioner comprises:

acquiring a real time when the local air conditioner detects the positioning marker from a time when the local air conditioner detects the positioning marker; acquiring detection information of a peripheral air conditioner in network connection with the local air conditioner, wherein the detection information comprises: detecting the positioning marker and the real time when detecting the positioning marker, or, failing to detect the positioning marker; and determining whether there are other air conditioners that detect the positioning marker simultaneously with the local air conditioner among the peripheral air conditioners according to the real time when the local air conditioner detects the positioning marker and the detection information of the peripheral air conditioners.

In some embodiments, from the time when the local air conditioner can detect the positioning marker, a time period in which the local air conditioner can detect the positioning marker is determined during the movement of the positioning marker, and it is determined whether there are any other air conditioner that can also detect the positioning marker within the time period. In some embodiments, only those air conditioners with a detection area adjacent to the detection area of the local air conditioner are detected, thereby reducing the amount of computation. If there are other air conditioners that can also detect the positioning marker within the time period in which the local air conditioner can detect the positioning marker, an overlapping time period is determined, within which the position of the positioning marker falls into an overlapping area of the detection areas of the local air conditioner and the other air conditioners.

For example: the local air conditioner is the air conditioner A, and the air conditioner B is one of peripheral air conditioners in communication with the air conditioner A and has an overlapping detection area with the air conditioner A. According to the above assumed application scenario, the above related embodiment is described below.

In practical applications, in the case of the above assumed application scenario, only the air conditioner B can detect the positioning marker simultaneously with the air conditioner A, among the peripheral air conditioners of the air conditioner A. The following description will be made for the air conditioner A and the air conditioner B. Because of different placements of the positioning marker, the specific processes that the air conditioner A and the air conditioner B simultaneously detect the positioning marker are different as follows.

In one case, the positioning marker is just placed in the overlapping detection area of the air conditioner A and the air conditioner B, such that the air conditioner A and the air conditioner B initially detect the positioning marker simultaneously. For example, the air conditioner A detects the positioning marker from 10:00:00 and the air conditioner B does so, and it is known that the air conditioner A and the air conditioner B are determined to detect the positioning marker simultaneously at the real time of 10:00:00.

In another case, the air conditioner A detects the positioning marker first, and then as the positioning marker moves, the air conditioner A and the air conditioner B happen to detect the positioning marker simultaneously. For example, the air conditioner A detects the positioning marker from 10:00:00, but the positioning marker is not successfully detected by the air conditioner B at the same time. The real time when the air conditioner A detects the positioning marker is obtained, the air conditioner B detects the positioning marker at 10:00:02 as the positioning marker moves, and at this moment, the real time when the air conditioner A detects the positioning marker is 10:00:02, and it is known that the air conditioner A and the air conditioner B are determined to detect the positioning marker simultaneously at the real time of 10:00:02.

In still another case, the air conditioner B first detects the positioning marker, and then as the positioning marker moves, the air conditioner A and the air conditioner B happen to detect the positioning marker simultaneously. For example, the air conditioner A detects the positioning marker at 10:00:00, and the air conditioner B continuously detects the positioning marker from 9:59:58, and it is known that the air conditioner A and the air conditioner B are determined to detect the positioning marker simultaneously at the real time of 10:00:00.

Step S103, if there are any other air conditioner that detects the positioning marker simultaneously with the local air conditioner, a position relation between the local air conditioner and the other air conditioner from the positioning marker is obtained.

In the step S103, if there are other air conditioners that detect the positioning marker simultaneously with the local air conditioner, a position relation between the two are obtained from the positioning marker. For example, in some embodiments, that if there are other air conditioners that detect the positioning marker simultaneously with the local air conditioner, obtaining a position relation between the local air conditioner and the other air conditioners according to the positioning marker comprises: obtaining the position relation between the local air conditioner and the other air conditioners according to positioning positions of the positioning marker in detection area of the local air conditioner and in detection area of the other air conditioners respectively.

In the above embodiment, the detection areas of the local air conditioner and the other air conditioners are determined according to their respective detecting sensors, wherein ranges of the detection areas are obtained according to practical situations, and then the detection areas are preset in the air conditioners.

In some embodiments, that obtaining the position relation between the local air conditioner and the other air conditioners according to the positioning positions of the positioning marker in the detection areas of the local air conditioner and the other air conditioners respectively comprises:

determining a position relation between a vertical projection position of the local air conditioner and the positioning marker according to the detection area of the local air conditioner; determining a position relation between vertical projection position of the other air conditioner and the positioning marker according to the detection area of the other air conditioner; and obtaining the position relation between the local air conditioner and the other air conditioner according to the position relation between the vertical projection position of the local air conditioner and the positioning marker, and according to the position relation between the vertical projection position of the other air conditioner and the positioning marker.

In some embodiments, the position relation between the local air conditioner and the other air conditioner comprises at least one of: a relative position between the vertical projection position of the local air conditioner and the vertical projection position of the other air conditioner; or an overlapping detection area between the local air conditioner and the other air conditioner.

The present disclosure obtains other air conditioner which detects the positioning marker simultaneously with the local air conditioner according to the positioning marker, and then, according to the positioning marker, obtains the position relation between the local air conditioner and the other air conditioners that detect the positioning marker simultaneously with the local air conditioner, which is favorable for providing accurate position information for the control of intelligent air conditioners having overlapping detection areas.

The above related embodiment is described below through specific application scenarios.

Figure 2:
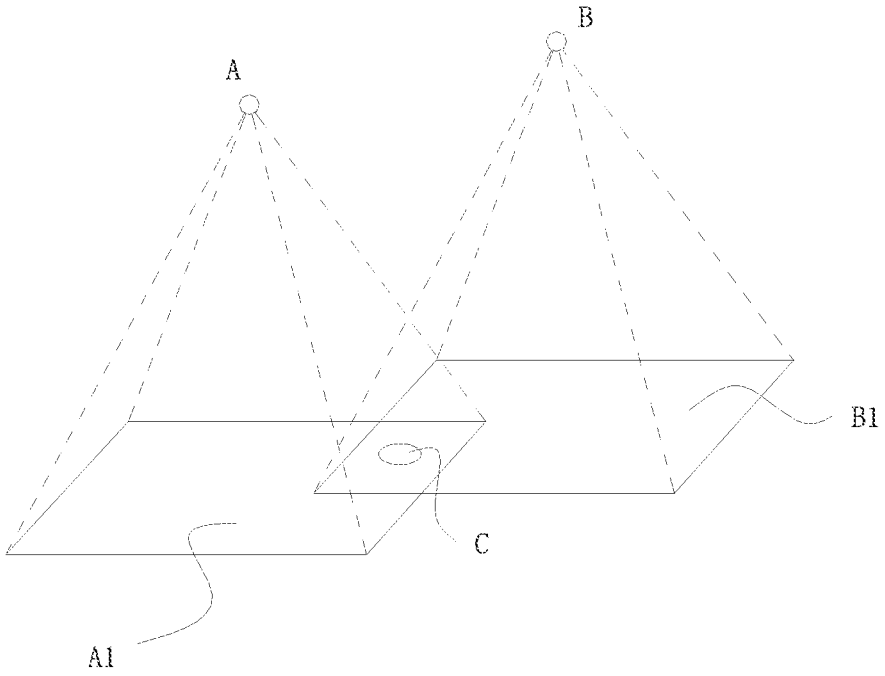
FIG. 2 is a schematic view of an application scenario of an air conditioner control method according to an embodiment of the present disclosure.
Figure 3:
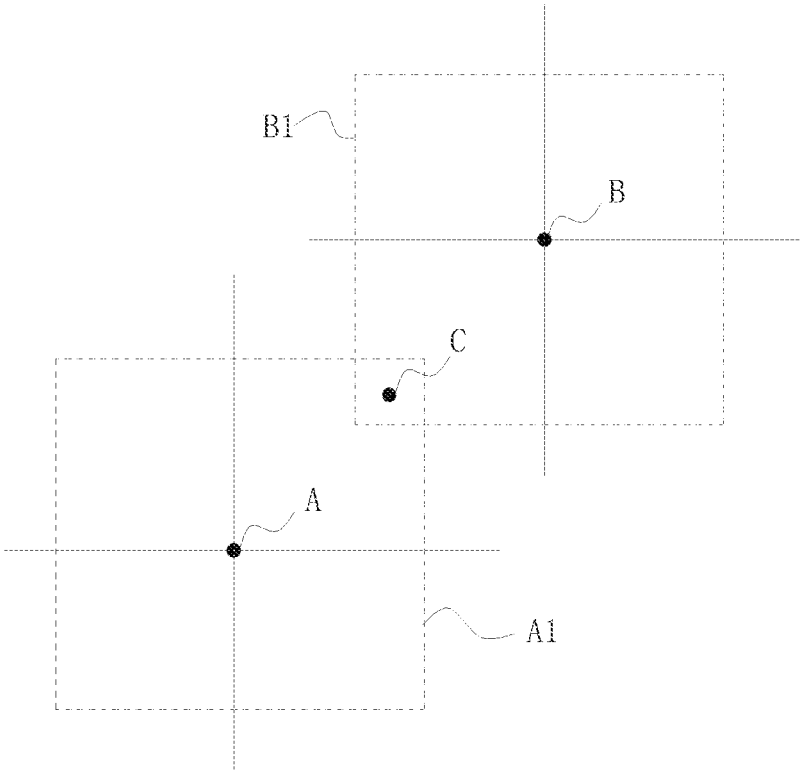
FIG. 3 is a schematic view of a position relation of air conditioners in coordinate systems according to an embodiment of the present disclosure.

FIG. 2 is a schematic view of an application scenario of an air conditioner control method according to an embodiment of the present disclosure. As shown in FIG. 2, both the air conditioner A and the air conditioner B are embedded air conditioners, which are also called ceiling-mounted air conditioners. As can be seen from FIG. 2, the air conditioner A corresponds to a detection area A1, and the air conditioner B corresponds to a detection area B1, and a positioning marker C are detected simultaneously by the air conditioner A and the air conditioner B. Rectangular coordinate systems are established with respective vertical projection points of the air conditioner A and the air conditioner B as the origins, such that the detection area ranges and coordinate positions of the positioning marker in the coordinate systems are obtained, as shown in FIG. 3. FIG. 3 is a schematic view of some embodiments of an air conditioner position relation in coordinate systems according to an embodiment of the present disclosure, wherein it is assumed that the coordinate position of the positioning marker is (3, 3) in the coordinate system of the detection area of the air conditioner A and (−3, −3) in the coordinate system of the detection area of air conditioner B, then the position of the air conditioner B is (6, 6) in the coordinate system of the detection area of the air conditioner A, and the position of the air conditioner A is (−6, −6) in the coordinate system of the detection area of the air conditioner B, thus the relative position between the vertical projection position of the local air conditioner and the vertical projection position of the other air conditioner are obtained, for example, an orientation relation between the vertical projection position of the local air conditioner and the vertical projection position of the other air conditioner, and a distance between the vertical projection position of the local air conditioner and the vertical projection position of the other air conditioner.

As shown in FIG. 3, the overlapping detection area of the air conditioners A and B are accurately obtained according to the specific positions of the respective detection areas of the air conditioners A and B in their corresponding coordinate systems. In FIG. 3, a dashed box indicated by A1 is the detection area of the air conditioner A, and a dashed box indicated by B1 is a detection region of air conditioner B.

The application of the rectangular coordinate system is given above, and in a specific application, the rectangular coordinate system may be replaced by a polar coordinate system.

In some embodiments, that obtaining the position relation between the local air conditioner and the other air conditioner according to the positioning positions of the positioning marker in the detection areas of the local air conditioner and the other air conditioner respectively further comprises: acquiring installation heights of the local air conditioner and the other air conditioner; and obtaining the position relation between the local air conditioner and the other air conditioner according to the installation heights of the local air conditioner and the other air conditioner.

It will be appreciated that the actual position relation between the local air conditioner and the other air conditioner are obtained through the installation heights of the local air conditioner and the other air conditioner. For example, since the installation heights of the air conditioners may be different, scales of the detection areas need to be adjusted according to the installation heights of the air conditioners, so that the overlapping areas of the detection areas of the respective air conditioners are determined at the same scale.

In some embodiments, if the positioning marker is a heat source having a specific temperature; that in the case that there are any other air conditioner which detect the positioning marker simultaneously with the local air conditioner, obtaining the position relation between the local air conditioner and the other air conditioners according to the positioning marker comprises: acquiring a first temperature profile obtained by the local air conditioner detecting its detection area; acquiring a second temperature profile obtained by the other air conditioner detecting its detection area; and obtaining the position relation between the local air conditioner and the other air conditioner according to positions of the specific temperature of the heat source in the first temperature profile and in the second temperature profile.

In the specific applications of the embodiment, the air conditioner is provided with an infrared thermopile sensor, through which the temperature profile of the detection area is obtained, and the position relation between the local air conditioner and the other air conditioner are obtained according to the positions of the specific temperature of the heat source in the temperature profiles.

In conclusion, the present disclosure obtains the other air conditioner which detect the positioning marker simultaneously with the local air conditioner with the use of the positioning marker, and then, according to the positioning marker, obtains the position relation between the local air conditioner and the other air conditioners that detect the positioning marker simultaneously with the local air conditioner, which is favorable for providing accurate relative position information for the control of intelligent air conditioners having overlapping detection areas, thereby realizing cooperating among the air conditioners for the overlapping detection areas. For example, according to the obtained overlapping detection area, when two air conditioners simultaneously detect that a person is in their overlapping detection area, only one of the air conditioners will execute the corresponding control action.

Figure 4:
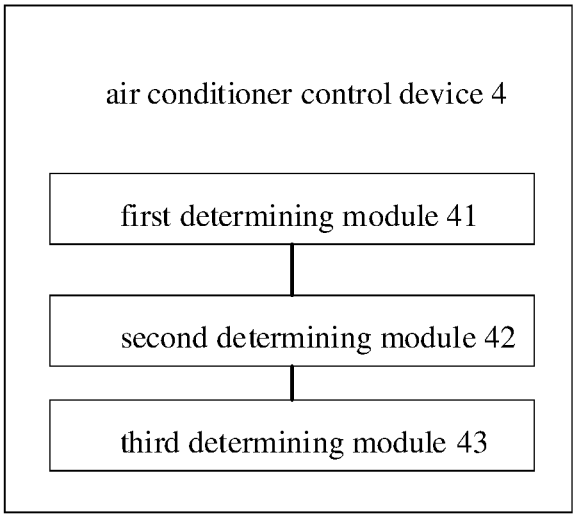
FIG. 4 is a schematic structural diagram of an air conditioner control device according to an embodiment of the present disclosure.

FIG. 4 is a schematic structural diagram of an air conditioner control device according to some embodiments of the present disclosure, and as shown in FIG. 4, an air conditioner control device 4 comprises:

a first determining module 41, capable of determining whether a local air conditioner detects a positioning marker;

a second determining module 42, capable of determining whether there are any other air conditioner that detect the positioning marker simultaneously with the local air conditioner when the local air conditioner detects the positioning marker; and a third determining module 43, capable of obtaining a position relation between the local air conditioner and the other air conditioner according to the positioning marker in the case that it is determined that there are other air conditioner which detect the positioning marker simultaneously with the local air conditioner.

In some embodiments, the first determining module 41 is capable of acquiring detection information of a detection area corresponding to the local air conditioner, and determining whether the local air conditioner detects the positioning marker according to the detection information of the detection area corresponding to the local air conditioner.

In some embodiments, that determining whether the local air conditioner detects the positioning marker according to the detection information of the detection area corresponding to the local air conditioner comprises: determining whether detection information matched with characteristic information of the positioning marker appears according to preset characteristic information of the positioning marker, and if so, determining that the local air conditioner detects the positioning marker successfully. In some embodiments, the characteristic information comprises at least one of temperature information, size information, or shape information.

In some embodiments, the second determining module 42 is capable of acquiring a real time when the local air conditioner detects the positioning marker from a time when the local air conditioner beginning detecting the positioning marker successfully; and acquiring detection information of a peripheral air conditioner in network connection with the local air conditioner, wherein the detection information comprises: detecting the positioning marker and the real time when detecting the positioning marker, or, failing to detect the positioning marker; and determining whether there are other air conditioner which detect the positioning marker simultaneously with the local air conditioner among the peripheral air conditioners, according to the real time when the local air conditioner detects the positioning marker and the detection information of the peripheral air conditioners.

In some embodiments, the third determining module 43 is capable of obtaining the position relation between the local air conditioner and the other air conditioners according to positioning positions of the positioning marker in detection areas of the local air conditioner and in detection areas of the other air conditioner respectively.

In some embodiments, that obtaining the position relation between the local air conditioner and the other air conditioner according to the positioning positions of the positioning marker in the detection areas of the local air conditioner and in detection areas of the other air conditioner respectively, comprises: determining a position relation between a vertical projection position of the local air conditioner in the detection area of the local air conditioner and the positioning marker according to the detection area of the local air conditioner; determining a position relation between vertical projection position of the other air conditioner in the detection area of the other air conditioner and the positioning marker according to the detection area of the other air conditioner; and obtaining the position relation between the local air conditioner and the other air conditioner according to the position relation between the vertical projection position of the local air conditioner and the positioning marker, and according to the position relation between the vertical projection position of other air conditioner and the positioning marker.

In some embodiments, the position relation between the local air conditioner and the other air conditioners comprises at least one of: a relative position relation between the vertical projection position of the local air conditioner and the vertical projection position of the other air conditioner; or an overlapping detection area between the local air conditioner and the other air conditioner.

In some embodiments, that obtaining the position relation between the local air conditioner and the other air conditioners according to the positioning positions of the positioning marker in the detection areas of the local air conditioner and the other air conditioners respectively, further comprises: acquiring installation heights of the air conditioner and the other air conditioner; and obtaining the position relation between the local air conditioner and the other air conditioner according to the installation heights of the local air conditioner and the other air conditioner.

In some embodiments, if the positioning marker is a heat source having a specific temperature, the third determining module 43 is capable of: acquiring a first temperature profile obtained by the local air conditioner detecting its detection area; acquiring a second temperature profile obtained by the other air conditioner detecting its detection area; and obtaining the position relation between the local air conditioner and the other air conditioner according to positions of the specific temperature of the heat source in the first temperature profile and in the second temperature profile.

Figure 5:
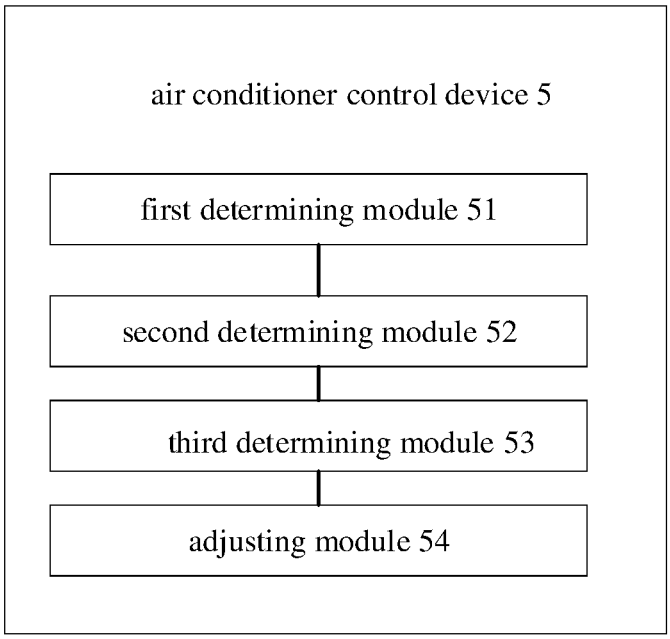
FIG. 5 is a schematic view of an air conditioner control device according to other embodiments of the present disclosure.

FIG. 5 is a schematic view of an air conditioner control device according to another embodiment of the present disclosure. A first, second and third determining modules 51, 52, 53 are similar to those in the embodiment shown in FIG. 4. The air conditioner control device also comprise an adjusting module 54, which is capable of adjusting working states of the local air conditioner and the other air conditioner according to the position relation between the air conditioners. For example, when it is required to increase or decrease the amount of air supply to the overlapping detection area, one of the air conditioners that can cover the overlapping area is adjusted first, thereby avoiding excessive adjustment. In the case that the target effect is not achieved by adjusting one air conditioner, the working state of one or more air conditioners covering the area is adjusted. In some embodiments, the adjusted air conditioners are added one by one.

Specific manners in which the modules of the device perform operations in the above embodiments have been described in detail in the embodiments related to the method, and will not be described in detail herein.

Figure 6:
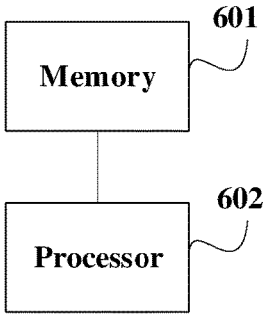
FIG. 6 is a schematic view of an air conditioner control device according to still other embodiments of the present disclosure.

FIG. 6 is a schematic structural diagram of an air conditioner control device according to some embodiments of the present disclosure. The air conditioner control device comprises a memory 601 and a processor 602, wherein the memory 601 may be a magnetic disk, flash memory, or any other non-volatile storage medium. The memory is used for storing instructions in the corresponding embodiments of the air conditioner control method above. Coupled to the memory 601 is a processor 602, which may be implemented as one or more integrated circuits, such as a microprocessor or microcontroller. The processor 602 is configured to execute instructions stored in the memory, and is capable of determining the relative position relation between air conditioners, thereby improving the accuracy of adjustment of the overlapping coverage areas and reducing energy waste.

Figure 7:
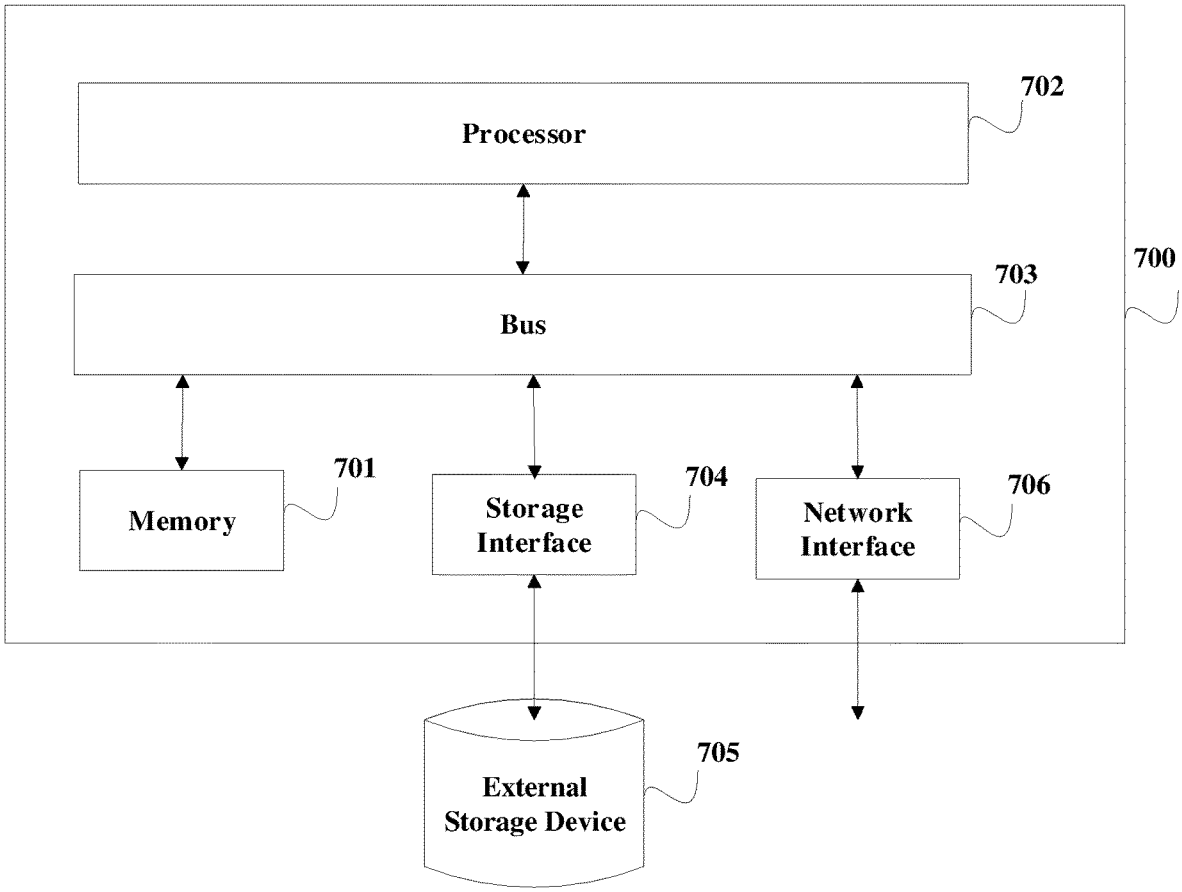
FIG. 7 is a schematic view of an air conditioner control device according to further embodiments of the present disclosure.

In some embodiments, as also shown in FIG. 7, an air conditioner control device 700 comprises a memory 701 and a processor 702. The processor 702 is coupled to the memory 701 through a bus 703. The air conditioner control device 700 may also be connected to an external storage device 705 through a storage interface 704 to call external data, and also to a network or another computer system (not shown) through a network interface 706. And it will not be described in detail herein.

In the embodiment, the relative position relation between air conditioners is determined by storing data instructions in the memory and processing the instructions by the processor, thereby improving the accuracy of adjustment of the overlapping coverage areas and reducing energy waste.

Other embodiments provide a computer-readable storage medium having stored thereon computer program instructions which, when executed by a processor, implement the steps of the air conditioner control method according to the corresponding embodiments. It should be appreciated by one skilled in the art that the embodiments of the present disclosure may be provided as a method, device, or computer program product. Accordingly, the present disclosure may take the form of an entirely hardware embodiment, an entirely software embodiment or an embodiment combining software and hardware aspects. Furthermore, the present disclosure may take the form of a computer program product embodied on one or more computer-usable non-transitory storage media (including, but not limited to, disk storage, CD-ROM, optical storage, and so forth) having computer-usable program code therein.

Figure 8:
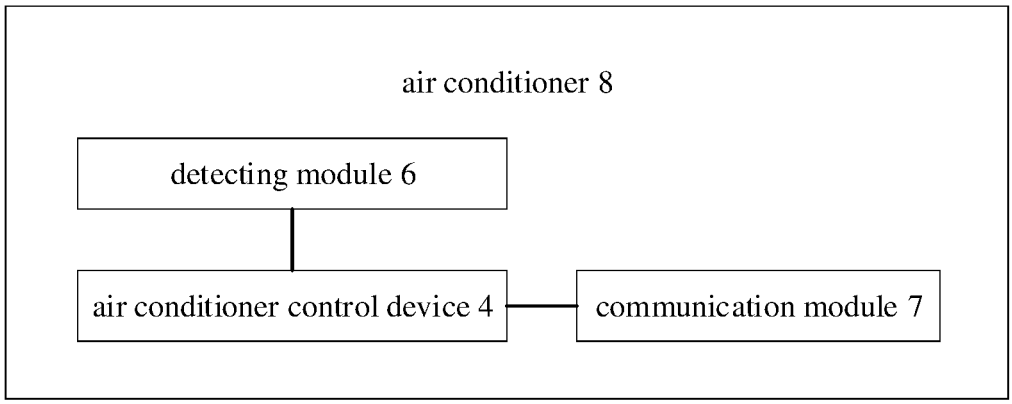
FIG. 8 is a schematic structural diagram of an air conditioner according to an embodiment of the present disclosure.

FIG. 8 is a schematic structural diagram of an air conditioner according to an embodiment of the present disclosure, and as shown in FIG. 8, the air conditioner 8 comprises a detecting module 6 capable of detecting a positioning marker, a communication module 7 capable of acquiring information of a peripheral air conditioner detecting the positioning marker, and the air conditioner control device 4 of any of the above.

In some embodiments, the detecting module 6 may be an infrared thermopile sensor.

With respect to the air conditioner in the above embodiments, the specific manners have been described in detail in the embodiments related to the method, and will not be described herein.

It will be appreciated that the same or similar parts in each of the above embodiments may be mutually referred to, and the same or similar contents in other embodiments may be referred to for the contents which are not described in detail in some embodiments.

It should be noted that, in the application description, the terms "first", "second", etc. are used for descriptive purposes only and are not to be construed as indicating or implying relative importance. Further, in the description of the present disclosure, "a plurality" means at least two unless otherwise specified.

Any process or method descriptions in flow charts or otherwise described herein may be understood as representing modules, segments, or portions of code which include one or more executable instructions for implementing specific logical functions or steps in the process, and alternate implementations are included within the scope of the preferred embodiment of the present disclosure in which functions may be executed out of order from that shown or discussed, including substantially concurrently or in reverse order, depending on the functions involved, which would be understood by those skilled in the art of the embodiments of the present disclosure.

It should be appreciated that each portion of the present disclosure may be implemented in hardware, software, firmware, or a combination thereof. In the above embodiments, various steps or methods may be implemented in software or firmware stored in a memory and executed by a suitable instruction execution system. For example, if implemented in hardware, as in another embodiment, any one or combination of the following technologies, which are well known in the art, may be used: a discrete logic circuit having a logic gate circuit for implementing a logic function on a data signal, an application specific integrated circuit having an appropriate combinational logic gate circuit, a Programmable Gate Array (PGA), a Field Programmable Gate Array (FPGA), or the like.

It will be understood by those skilled in the art that all or part of the steps carried out in the method of implementing the above embodiments may be implemented by a program instructing a related hardware, wherein the program may be stored in a computer-readable storage medium and comprises one or a combination of the steps of the method embodiments when executed.

In addition, functional units in the embodiments of the present disclosure may be integrated into one processing module, or each unit may exist alone physically, or two or more units are integrated into one module. The integrated module is implemented in a hardware form, and also in a form of a software functional module. The integrated module, if implemented in the form of a software functional module and sold or used as a separate product, may also be stored in a computer-readable storage medium.

The aforementioned storage medium may be a read-only memory, a magnetic or optical disk, etc.

In the description of the present specification, reference to the description of terms "one embodiment," "some embodiments," "an example," "a specific example," or "some examples" or the like means that a particular feature, structure, material, or characteristic described in connection with the embodiment or example is included in at least one embodiment or example of the present disclosure. In this specification, the schematic representations of the above terms do not necessarily refer to the same embodiment or example. Furthermore, the particular features, structures, materials, or characteristics described may be combined in any suitable manner in any one or more embodiments or examples.

While embodiments of the present disclosure have been shown and described above, it will be appreciated that the above embodiments are exemplary and should not be construed as limiting the present disclosure and that changes, modifications, substitutions and variations may be made to the above embodiments by those of ordinary skill in the art within the scope of the present disclosure.

What is claimed is:

1. An air conditioner control method comprising:

determining whether a local air conditioner detects a positioning marker;

determining whether there are any other air conditioners that detect the positioning marker simultaneously with the local air conditioner, in the case that the local air conditioner detects the positioning marker;

determining a position relation between the local air conditioner and the other air conditioners according to the positioning marker, in the case that other air conditioners detect the positioning marker simultaneously with the local air conditioner; and adjusting working states of the local air conditioner and the other air conditioners according to the position relation.

2. The air conditioner control method according to claim 1, wherein determining whether the local air conditioner detects the positioning marker comprises:

acquiring detection information of a detection area corresponding to the local air conditioner; and determining whether the local air conditioner detects the positioning marker according to the detection information of the detection area corresponding to the local air conditioner.

3. The air conditioner control method according to claim 2, wherein determining whether the local air conditioner detects the positioning marker according to the detection information of the detection area corresponding to the local air conditioner comprises:

determining whether there is detection information matched with characteristic information of the positioning marker in the detection information of the detection area of the local air conditioner, according to preset characteristic information of the positioning marker; and determining that the local air conditioner detects the positioning marker in the case that there is the detection information matched with the characteristic information of the positioning marker.

4. The air conditioner control method according to claim 3, wherein the characteristic information comprises at least one of temperature information, shape information, or size information.

5. The air conditioner control method according to claim 1, wherein determining whether there are the other air conditioners that detect the positioning marker simultaneously with the local air conditioner comprises:

acquiring a real time when the local air conditioner can detect the positioning marker from a time when the local air conditioner detects the positioning marker;

acquiring detection information of air conditioners adjacent to a detection area of the local air conditioner and in network connection with the local air conditioner, wherein the detection information comprises: detecting the positioning marker and the real time when detecting the positioning marker, or, failing to detect the positioning marker;

determining whether there are any air conditioners with real time when they can detect the positioning marker overlapped with the real time when the local air conditioner can detect the positioning marker respectively, according to the real time when the local air conditioner can detect the positioning marker and the detection information of the air conditioners adjacent to the detection area of the local air conditioner; and determining that the air conditioner with the real time when they can detect the positioning marker overlapped with the real time when the local air conditioner can detect the positioning marker is the other air conditioner which detected the positioning marker simultaneously with the local air conditioner.

6. The air conditioner control method according to claim 1, wherein determining the position relation between the local air conditioner and the other air conditioners comprises:

determining the position relation between the local air conditioner and the other air conditioners according to positioning positions of the positioning marker in detection area of the local air conditioner and detection area of the one of the other air conditioners respectively.

7. The air conditioner control method according to claim 6, wherein determining the position relation between the local air conditioner and the other air conditioners comprises:

determining a position relation between a vertical projection position of the local air conditioner in the detection area of the local air conditioner, and the position of the positioning marker in the detection area of the local air conditioner;

determining a position relation between vertical projection positions of the other air conditioners in the detection area of the other air conditioners, and the position of the positioning marker in the detection areas of the other air conditioners; and determining the position relation between the local air conditioner and the other air conditioner according to the position relation between the vertical projection position of the local air conditioner and the positioning marker, and the position relation between the vertical projection positions of the other air conditioners and the positioning marker.

8. The air conditioner control method according to claim 7, wherein the position relation between the local air conditioner and the other air conditioners comprises at least one of:

a relative position between the vertical projection position of the local air conditioner and the vertical projection positions of the other air conditioners; or an overlapping detection area between the local air conditioner and the other air conditioners.

9. The air conditioner control method according to claim 7, wherein determining the position relation between the local air conditioner and the other air conditioners further comprises:

acquiring installation heights of the local air conditioner and the other air conditioners; and determining the position relation between the local air conditioner and the other air conditioners according to the installation heights of the local air conditioner and the other air conditioners.

10. The air conditioner control method according to claim 6, wherein in the case that the positioning marker is a heat source having a preset temperature, determining the position relation between the local air conditioner and the other air conditioners comprises:

acquiring a first temperature profile obtained by the local air conditioner detecting its detection area;

acquiring second temperature profile obtained by the other air conditioners detecting their detection areas; and determining the position relation between the local air conditioner and the other air conditioners according to positions of the preset temperature of the heat source in the first temperature profile and each of the second temperature profiles respectively.

11. The air conditioner control method according to claim 1, wherein adjusting the working states of the local air conditioner and the other air conditioners according to the position relation comprises:

determining whether an adjusted detection area is an overlapping area of the detection areas among air conditioners; and adjusting the working states of part of the air conditioners covering the overlapping area, in the case that the adjusted detection area is the overlapping area.

12. An air conditioner control device comprising:

a memory; and a processor coupled to the memory, which, based on instructions stored in the memory, is configured to perform the method comprising:

determining whether a local air conditioner detects a positioning marker;

determining whether there are any other air conditioners that detect the positioning marker simultaneously with the local air conditioner, in the case that the local air conditioner detects the positioning marker;

determining a position relation between the local air conditioner and the other air conditioners according to the positioning marker, in the case that the other air conditioners detect the positioning marker simultaneously with the local air conditioner; and adjusting working states of the local air conditioner and the other air conditioners according to the position relation.

13. An air conditioner comprising:

a detector configured to detect a positioning marker;

a communication device configured to acquire detection information of the positioning marker by air conditioners adjacent to a detection area of the air conditioner; and an air conditioner control device as claimed in claim 12.

14. The air conditioner according to claim 13, wherein the detector is an infrared thermopile sensor.

15. The air conditioner control device according to claim 12, wherein adjusting working states of the local air conditioner and the other air conditioners according to the position relation comprises:

determining whether an adjusted detection area is an overlapping area of detection areas among air conditioners; and adjusting the working states of part of the air conditioners covering the overlapping area, in the case that the adjusted detection area is the overlapping area.

16. A non-transitory computer-readable storage medium storing a computer program that, when being executed by a processor, implement method for performing operations comprising:

determining whether a local air conditioner detects a positioning marker;

determining whether there are any other air conditioners that detect the positioning marker simultaneously with the local air conditioner, in the case that the local air conditioner detects the positioning marker;

determining a position relation between the local air conditioner and the other air conditioners according to the positioning marker, in the case that the other air conditioners detect the positioning marker simultaneously with the local air conditioner; and adjusting working states of the local air conditioner and the other air conditioners according to the position relation.

17. The non-transitory computer-readable storage medium according to claim 16, wherein adjusting working states of the local air conditioner and the other air conditioners according to the position relation comprises:

determining whether an adjusted detection area is an overlapping area of detection areas among air conditioners; and adjusting the working states of part of the air conditioners covering the overlapping area, in the case that the adjusted detection area is the overlapping area.

* * * * *